US011380233B2

(12) United States Patent
Lee et al.

(10) Patent No.: US 11,380,233 B2
(45) Date of Patent: Jul. 5, 2022

(54) DISPLAY DEVICE AND METHOD OF INSPECTING THEREOF

(71) Applicant: Samsung Display Co., Ltd., Yongin-si (KR)

(72) Inventors: Ji Young Lee, Yongin-si (KR); Yong Bin Kim, Yongin-si (KR); Gun Woo Yang, Yongin-si (KR); Hyun Young Choi, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 17/197,963

(22) Filed: Mar. 10, 2021

(65) Prior Publication Data

US 2021/0335167 A1 Oct. 28, 2021

(30) Foreign Application Priority Data

Apr. 22, 2020 (KR) ..... 10-2020-0048905

(51) Int. Cl.

| | |
|---|---|
| ***G09G 3/00*** | (2006.01) |
| ***G09G 3/3266*** | (2016.01) |
| ***G09G 3/3233*** | (2016.01) |
| *G09G 3/3275* | (2016.01) |

(52) U.S. Cl.

CPC ..... *G09G 3/006* (2013.01); *G09G 3/3233* (2013.01); *G09G 3/3266* (2013.01); *G09G 3/3275* (2013.01); *G09G 2330/02* (2013.01); *G09G 2330/10* (2013.01)

(58) Field of Classification Search

None

See application file for complete search history.

(56) References Cited

U.S. PATENT DOCUMENTS

| | | | | |
|---|---|---|---|---|
| 2020/0402432 | A1* | 12/2020 | Yang | G09G 3/3241 |
| 2021/0056914 | A1* | 2/2021 | Suzuki | G09G 3/006 |
| 2021/0210016 | A1* | 7/2021 | Li | G09G 3/3291 |

FOREIGN PATENT DOCUMENTS

| | | | |
|---|---|---|---|
| CN | 106652915 | A | 5/2017 |
| KR | 10-2015-0104241 | A | 9/2015 |
| KR | 10-2017-0090539 | A | 8/2017 |
| KR | 10-2020-0145903 | A | 12/2020 |

* cited by examiner

*Primary Examiner* — Christopher J Kohlman

(74) *Attorney, Agent, or Firm* — Lewis Roca Rothgerber Christie LLP

(57) ABSTRACT

A display device includes: a plurality of pixels connected to scan lines, emission control lines, data lines, and a power line; a scan driver configured to supply a scan signal to the scan lines; and an emission driver configured to supply an emission control signal to the emission control lines, wherein a voltage of a first power supplied to the power line during an inspection period has a pulse form alternating between a first level and a second level that is lower than the first level, and the display device is configured to maintain the voltage of the first power at a third level.

20 Claims, 14 Drawing Sheets

DISPLAY DEVICE AND METHOD OF INSPECTING THEREOF

CROSS-REFERENCE TO RELATED APPLICATION

The present application claims priority to and benefits of Korean Patent Application No. 10-2020-0048905 filed in the Korean Intellectual Property Office on Apr. 22, 2020, the entire content of which is incorporated herein by reference.

BACKGROUND

1. Field

Aspects of some example embodiments of the present invention relate to a display device and an inspecting method thereof.

2. Description of the Related Art

A display device displays an image by using a plurality of pixels. Each of the pixels includes a plurality of transistors and a light emitting element electrically connected thereto. The transistors are turned on in response to signals supplied through wires, thereby generating a driving current (e.g., a set or predetermined driving current). The light emitting element emits light in response to the driving current.

When at least one of the transistors has a connection defect, the pixels may not emit light with a desired luminance, and image deterioration may occur. A structure and an inspecting method of a display device capable of detecting connection defects of respective transistors and pixel defects according to the transistors may be utilized in order to improve image quality and reliability of a display device.

The above information disclosed in this section is only for enhancement of understanding of the background of the invention, and therefore it may contain information that does not constitute prior art.

SUMMARY

Aspects of some example embodiments of the present invention include a display device capable of detecting pixel defects by swinging a first power supply.

Aspects of some example embodiments of the present invention include a method for inspecting a display device, which detects pixel defects by swinging a first power supply.

Embodiments according to the present invention are not limited to the above-described characteristics, and may be variously extended or modified without departing from the spirit and scope of embodiments according to the present invention.

According to some example embodiments of the present invention, a display device includes: pixels connected to scan lines, emission control lines, data lines, and power lines; a scan driver configured to supply a scan signal to the scan lines; and a emission driver configured to supply an emission control signal to the emission control lines. A voltage of a first power supplied to the power line during an inspection period may have a pulse form alternating between a first level and a second level that is lower than the first level layer. The voltage of the first power may maintain a third level.

According to some example embodiments, the emission control signal may maintain a gate-on level during the inspection period.

According to some example embodiments, outputs of a gate-on level of the scan signal and the first level of the first power may overlap in a first period of the inspection period, and outputs of the gate-on level of the scan signal and the second level of the first power may overlap in a second period of the inspection period.

According to some example embodiments, in the inspection period, the voltage of the first power may change from the first level by overlapping a period in which the scan signal has a gate-on level.

According to some example embodiments, an inspection voltage may be supplied to the data lines during the inspection period, the first level of the first power may be greater than that of the inspection voltage, and the second level of the first power may be less than that of the inspection voltage.

According to some example embodiments, the display device may further include an inspector configured to detect a current flowing through the data lines during the inspection period.

According to some example embodiments, the inspector may determine whether the pixel is defective based on a result of comparing a change in a current detected in the first period and a change in a current detected in the second period with a reference current.

According to some example embodiments, a pixel of an $i^{th}$ horizontal line (where i is a natural number) among the pixels includes: a light emitting element; a first transistor configured to control a driving current flowing to the light emitting element based on a voltage of a first node, and connected between the second node and the third node; a second transistor connected between a $j^{th}$ data line (where j is a natural number) and the second node, to be turned on by a gate-on level of the scan signal supplied to an $i^{th}$ scan line; and a third transistor connected between the power line and the first electrode of the light emitting element to be turned on by the gate-on level of the scan signal supplied to the $i^{th}$ scan line, According to some example embodiments, a current path may be formed from the $j^{th}$ data line to the power line through the third transistor and the first transistor in the first period and the second period.

According to some example embodiments, the pixel may further include: a fourth transistor connected between the first node and the power line to be turned on by the gate-on level of the scan signal supplied to a $(i-1)^{th}$ scan line; a fifth transistor connected between a first driving power line for supplying a first driving power and the second node, to be turned on by a gate-on level of the emission control signal supplied to an $i^{th}$ emission control line; a sixth transistor connected between the third node and the first electrode of the light emitting element, to be turned on by the gate-on level of the emission control signal supplied to the $i^{th}$ emission control line; and a seventh transistor connected between the first node and the third node, to be turned on by the gate-on level of the scan signal supplied to the $i^{th}$ scan line.

According to some example embodiments, the display device may further include: a power supply configured to supply the first power to the power line; and a data driver configured to supply a data signal to the data lines during the display period.

According to some example embodiments, the third level may be equal to or greater than the second level and less than the first level.

According to some example embodiments of the present invention, in an inspecting method of a display device including a data line, a scan line, and a power line, and a pixel connected to the data line, the scan line, and the power line, the inspecting method includes: forming a current path flowing from the data line to the power line through the pixel by supplying a first power having a first level during a first period; detecting a current flowing through the data line during the first period; and detecting a current flowing through the data line by supplying the first power having a second level that is lower than the first level to the power line during a second period.

According to some example embodiments, a scan signal supplied to the scan line may have a gate-on level during the first period and the second period.

According to some example embodiments, an inspection voltage may be supplied to the data line during the first period and the second period, the first level of the first power may be greater than the inspection voltage, and the second level of the first power may be less than the inspection voltage.

According to some example embodiments, the detecting the current during the first period may include determining that the pixel has a defect when a first detection current detected during the first period increases or a direction of the first detection current is reversely changed.

According to some example embodiments, the detecting the current during the second period may include: determining that at least one of the transistors on the current path is defective when a second detection current detected during the second period is not increased; comparing a change amount of the second detection current and a reference range when the second detection current increases; and determining that at least one of the transistors on the current path is defective when the change amount of the second detection current is out of the reference range.

According to some example embodiments, the pixel may further include: a light emitting element; a first transistor configured to control a driving current flowing to the light emitting element based on a voltage of a first node, and connected between the second node and the third node; a second transistor connected between the data line and the second node, to be turned on by the gate-on level of the scan signal supplied to the scan line; a third transistor connected between the power line and the first electrode of the light emitting element to be turned on by the gate-on level of the scan signal supplied to the scan line; a fourth transistor connected between the first node and the power line to be turned on by the gate-on level of the scan signal supplied to a previous scan line; a fifth transistor connected between a first driving power line for supplying a first driving power and the second node, to be turned on by a gate-on level of an emission control signal supplied to an emission control line; a sixth transistor connected between the third node and the first electrode of the light emitting element, to be turned on by the gate-on level of the emission control signal supplied to the emission control line; and a seventh transistor connected between the first node and the third node, to be turned on by the gate-on level of the scan signal supplied to the scan line.

According to some example embodiments, it may be determined that the power line and the scan line are short circuited when the first detection current is increased.

According to some example embodiments, it may be determined that the seventh transistor is open or the first transistor is short circuited when the direction of the first detection current is reversely changed.

According to some example embodiments, it may be determined that a gate electrode of the sixth transistor is open when a change amount of the second detection current is less than the reference range.

In accordance with a display device and an inspecting method thereof according to embodiments of the present invention, a current path may be formed such that a current (e.g., a set or predetermined current) passes through all of the transistors turned on by the scan signal and the emission control signal based on the swing of the first power during the first period and the second period of the inspection period. Accordingly, connection (short circuit/open) defects to all transistors included in the pixel may be detected by using the detection currents during the first period and the second period. Therefore, accuracy and reliability of detection of connection defects of constituent elements inside the pixels may be improved, and image quality may be improved.

Embodiments according to the present invention are not limited to the above-described characteristics, and may be variously extended or modified without departing from the spirit and scope of embodiments according to the present invention.

DETAILED DESCRIPTION

Figure 1:
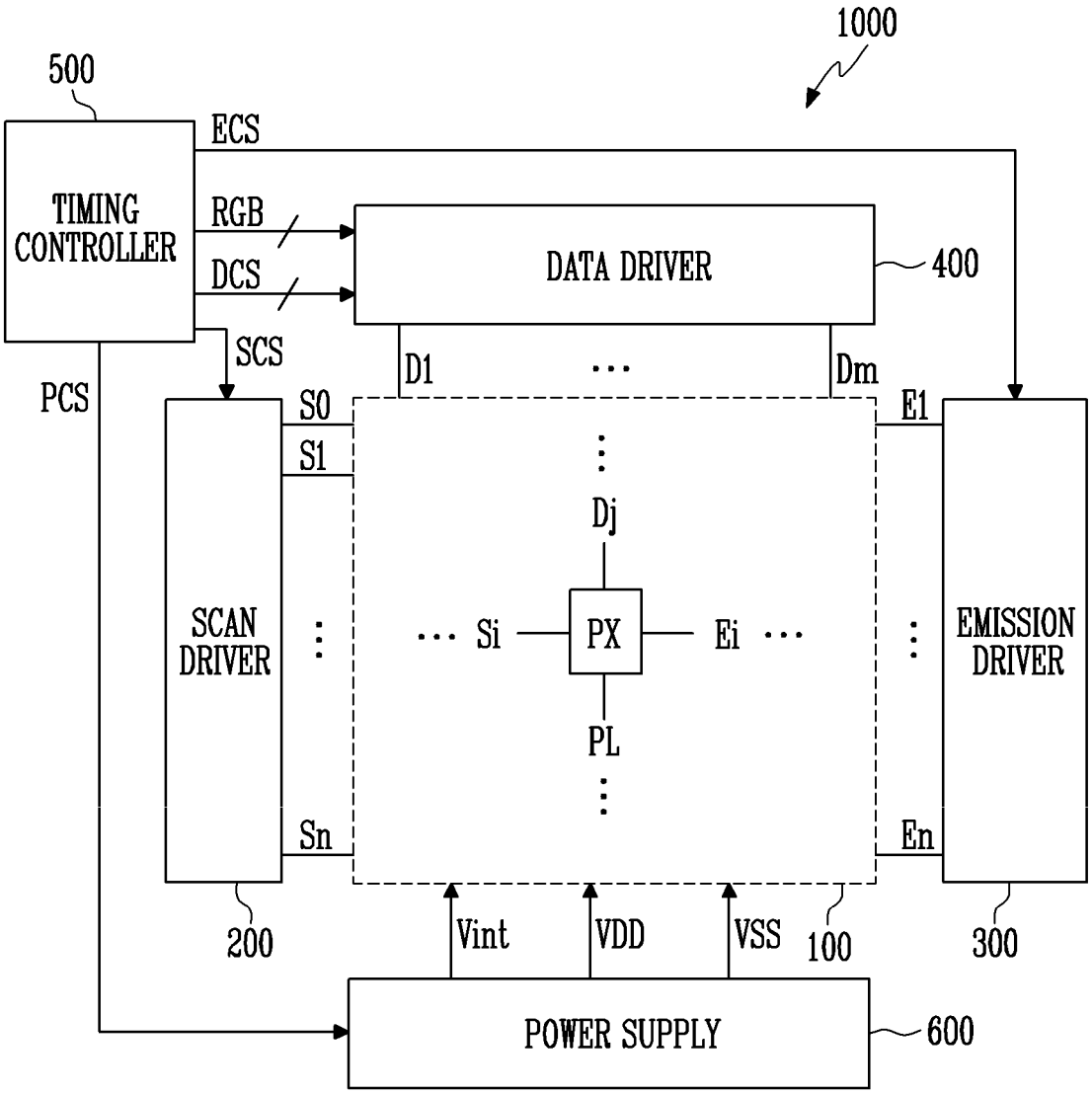
FIG. 1 illustrates a block diagram showing a display device according to some example embodiments of the present invention.

Hereinafter, aspects of some example embodiments of the present invention will be described in more detail with reference to accompanying drawings. The same reference numerals are used for the same constituent elements in the drawings, and duplicate descriptions for the same constituent elements will be omitted.

FIG. 1 illustrates a block diagram showing a display device according to some example embodiments of the present invention.

Referring to FIG. 1, the display device 1000 may include a pixel unit 100, a scan driver 200, an emission driver 300, a data driver 400, and a timing controller 500. According to some example embodiments, the display device 1000 may further include a power supply 600.

The pixel unit 100 may include a plurality of scan lines S1 to Sn, a plurality of emission control lines E1 to En, and a plurality of data lines D1 to Dm, and may further include pixels PX connected to the scan lines S1 to Sn, the emission control lines E1 to En, and the data lines D1 to Dm (where m and n are integers greater than 1). Each of the pixels PX may be further connected to a power line PL for supplying a voltage of a first power Vint.

According to some example embodiments, the pixel unit 100 may further include a dummy scan line S0 connected to the pixels PX of a first pixel row (horizontal line).

The timing controller 500 may generate a first control signal SCS, a second control signal ECS, and a third control signal DCS in response to synchronous signals supplied from the outside. The first control signal SCS may be supplied to the scan driver 200, the second control signal ECS may be supplied to the emission driver 300, and the third control signal DCS may be supplied to the data driver 400. In addition, the timing controller 500 may rearrange image data supplied from the outside to supply it to the data driver 400.

According to some example embodiments, the timing controller 500 may generate a fourth control signal PCS for controlling driving of the power supply 600. The fourth control signal PCS may control the supply timing of at least one of the first driving power VDD, the second driving power VSS, and the first power Vint (or an initialization power).

The scan driver 200 may receive the first control signal SCS from the timing controller 500 to supply a scan signal to the scan lines S1 to Sn based on the first control signal SCS. For example, the scan driver 200 may sequentially supply a scan signal to the scan lines S1 to Sn.

A transistor included in the pixel PX and receiving the scan signal may be turned on in response to a gate-on level of the scan signal.

According to some example embodiments, the scan driver 200 may also supply a scan signal to the dummy scan line S0 connected to the first pixel row (horizontal line). The dummy scan line S0 may be added by a circuit structure of the pixels PX. The scan signal may be sequentially supplied to the scan lines S1 to Sn starting from the dummy scan line S0.

The dummy scan line S0 may be omitted or additional dummy scan lines may be further included depending on the circuit structure of the pixels PX.

The emission driver 300 may receive a second control signal ECS from the timing controller 500 to supply an emission control signal to the emission control lines E1 to En based on the second control signal ECS. For example, the emission driver 300 may sequentially supply the emission control signal to the emission control lines E1 to En.

A transistor included in the pixel PX and receiving the emission control signal may be turned on in response to a gate-on level of the emission control signal.

The emission control signal is used to control an emission time of the pixels PX. For this purpose, a gate-off period of the emission control signal may be set to a wider width than a gate-on period of the scan signal. For example, the scan driver 200 may supply a scan signal to the $(i-1)^{th}$ scan line S(i−1) and the $i^{th}$ scan line Si to overlap a gate-off period of the emission control signal supplied to the $i^{th}$ emission control line Ei.

The scan driver 200 and the emission driver 300 may be mounted on a substrate through a thin film process. In addition, the scan driver 200 may be arranged at opposite sides with the pixel unit 100 arranged therebetween. The scan driver 200 may be also arranged at opposite sides with the pixel unit 100 located therebetween.

In addition, in FIG. 1, the scan driver 200 and the emission driver 300 are respectively illustrated to supply the scan signal and the emission control signal, but the present invention is not limited thereto. For example, the scan signal and the emission control signal may be supplied from one driver.

The data driver 400 may receive the third control signal DCS and an image data RGB from the timing controller 500. The data driver 400 may supply a data signal to the data lines D1 to Dm in response to the third control signal DCS. The data signal may be supplied to the pixels PX selected by the scan signal.

Meanwhile, in FIG. 1, n+1 scan lines S0 to Sn and n emission control lines E1 to En are respectively illustrated, but the present invention is not limited thereto. For example, the pixels PX positioned on a current horizontal line (or a current pixel row) corresponding to a circuit structure of the pixels PX may be further connected to the scan line positioned at a horizontal line (or a next pixel row). For this purpose, additional dummy scan lines and/or dummy emission control lines may be additionally formed in the pixel unit 100.

The power supply 600 may receive the fourth control signal PCS from the timing controller 500. The power supply 600 may generate a first power Vint, a first driving power VDD, and a second driving power VSS for driving the pixels PX in response to the fourth control signal PCS.

According to some example embodiments, during an inspection period for inspecting a connection defect of each of the pixels PX, the power supply 600 may supply a voltage of the first power Vint to the power line PL in a form of pulses in which a first level and a second level that is lower than the first level are alternated. During a display period, the power supply 600 may supply the voltage of the first power Vint in a direct current form.

At least one of the data driver 400, the timing controller 500, or the power supply 600 may be directly mounted on a substrate including the pixel unit 100, or may be connected to the substrate in a form of a tape carrier package (TCP). Alternatively, at least one of the data driver 400, the timing controller 500, or the power supply 600 may be integrated in a peripheral portion of the substrate.

On the other hand, the data driver 400, the timing controller 500, and the power supply 600 are illustrated in FIG. 1 as separate components, but at least some functions of the data driver 400, the timing controller 500, and the power supply 600 may be integrated in a form of an integrated circuit (IC).

Figure 2:
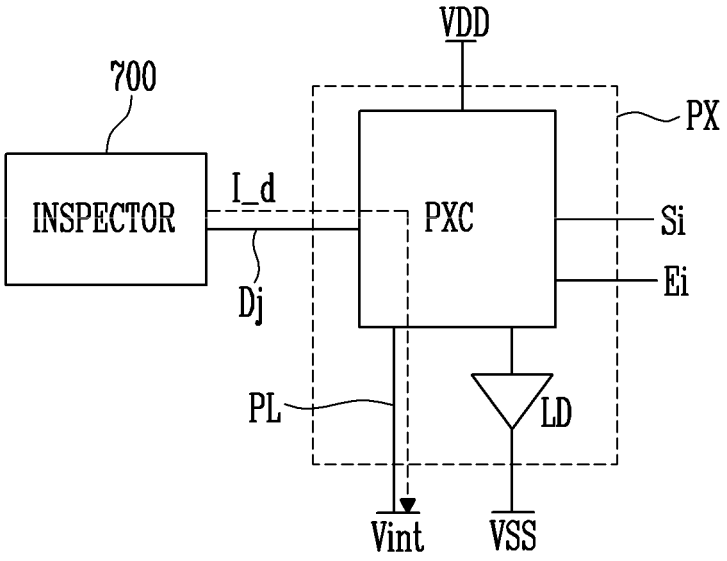
FIG. 2 illustrates a block diagram showing an inspector and a pixel included in the display device of FIG. 1.

FIG. 2 illustrates a block diagram showing an inspector and a pixel included in the display device of FIG. 1.

Referring to FIG. 1 and FIG. 2, each pixel PX may include a pixel circuit PXC and a light emitting element LD. The pixel circuit PXC may supply a driving current to the light emitting element LD.

The pixel circuit PXC includes a plurality of transistors, and may be connected to a scan line Si, a data line Dj, and an emission control line Ei. In addition, the pixel circuit PXC may receive the voltage of the first driving power VDD, and may receive the voltage of the first power Vint through the power line PL.

The light emitting element LD may be connected between the pixel circuit PXC and a wire for supplying the second driving power VSS. The light emitting element LD may emit light based on a driving current.

According to some example embodiments, the display device 1000 may further include an inspector 700 for inspecting a defect of the pixel PX. The inspector 700 may be connected to the data line Dj. For example, the inspector 700 may supply a voltage (e.g., a set or predetermined voltage) (e.g., an inspection voltage) to the data line Dj. Accordingly, a current path may be formed between the data line Dj and the power line PL. The inspector 700 detects a current I_d (detection current) flowing through the current path to determine whether a pixel is defective based on the detection current I_d.

Although the detection current I_d is shown in FIG. 2 as flowing from the inspector 700 to the power supply line PL, this is an example, and when a voltage supplied to the data line Dj is less than that of the first power Vint, the detection current I_d may flow from the power supply line PL to the inspector 700 through the data line Dj.

According to some example embodiments, the inspector 700 may be included in the display device 1000, or may be configured to be connected to the data line Dj as a separate configuration outside the display device 1000.

Figure 3:
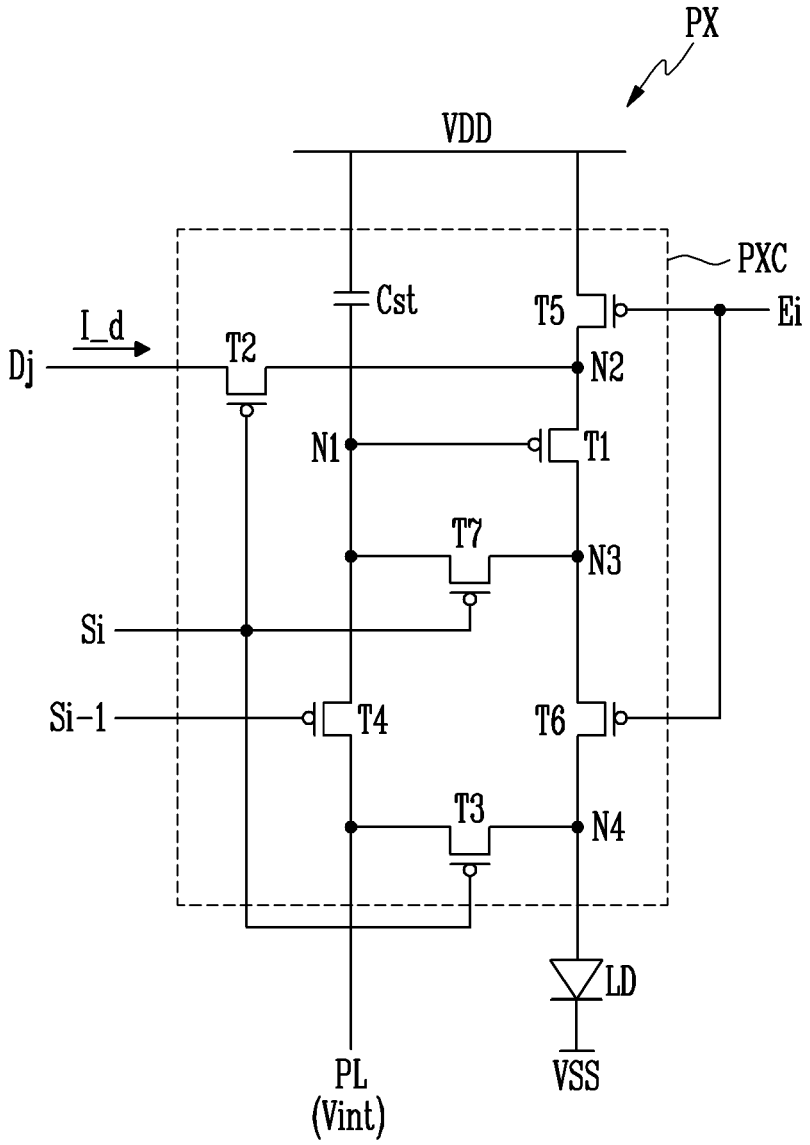
FIG. 3 illustrates a circuit diagram showing an example of a pixel included in the display device of FIG. 1.

FIG. 3 illustrates a circuit diagram showing an example of a pixel included in the display device of FIG. 1.

In FIG. 3, for convenience of description, a pixel arranged on the $i^{th}$ horizontal line and connected to the $j^{th}$ data line Dj will be illustrated.

Referring to FIG. 1 to FIG. 3, the pixel PX may include a light emitting element LD, first to seventh transistors T1 to T7, and a storage capacitor Cst.

A first electrode (anode or cathode) of the light emitting element LD may be connected to the fourth node N4, and a second electrode (cathode or anode) may be connected to a second driving power VSS. The light emitting element LD generates light having a luminance (e.g., a set or predetermined luminance) corresponding to an amount of current supplied from the first transistor T1.

According to some example embodiments, the light emitting element LD may be an organic light emitting diode (OLED) including an organic emission layer. According to some example embodiments, the light emitting element LD may be an inorganic light emitting element formed of an inorganic material. Alternatively, the light emitting element LD may have a form in which a plurality of inorganic light emitting elements are connected in parallel and/or in series between the second driving power VSS and the fourth node N4.

The first electrode of the first transistor T1 (or the driving transistor) is connected to the second node N2, and the second electrode is connected to the third node N3. A gate electrode of the first transistor T1 is connected to the first node N1. The first transistor T1 may control a driving current flowing from the first driving power VDD to the second driving power VSS through the light emitting element LD in response to a voltage of the first node N1. The first driving power VDD may be set to a higher voltage than the second driving power VSS.

The second transistor T2 is connected between the data line Dj and the second node N2. A gate electrode of the second transistor T2 is connected to the $i^{th}$ scan line Si. The second transistor T2 is turned on by a gate-on level of the scan signal supplied to the $i^{th}$ scan line Si to electrically connect the data line Dj and the second node N2.

The third transistor T3 is connected between the first electrode (that is, the fourth node N4) of the light emitting element LD and the power line PL supplying the first power Vint. A gate electrode of the third transistor T3 is connected to the $i^{th}$ scan line Si. The third transistor T3 may be turned on by the gate-on level of the scan signal supplied to the $i^{th}$ scan line Si to supply a voltage of the first power to the first electrode (that is, the fourth node N4) of the light emitting element LD.

The fourth transistor T4 is connected between the first node N1 and the power line PL. The gate electrode of the third transistor T4 is connected to the $(i-1)^{th}$ scan line S(i−1). The fourth transistor T4 is turned on by a gate-on level of the scan signal supplied to the $(i-1)^{th}$ scan line S(i−1) to supply the voltage of the first power Vint to the first node N1.

The fifth transistor T5 is connected between the first driving power line supplying the first driving power VDD and the second node N2. A gate electrode of the fifth transistor T5 is connected to the $i^{th}$ emission control line Ei. The fifth transistor T5 is turned on by the gate-on level of the emission control signal supplied to the $i^{th}$ emission control line Ei.

The sixth transistor T6 is connected between the second electrode (i.e., third node N3) of the first transistor T1 and the first electrode (i.e., fourth node N4) of the light emitting element LD. A gate electrode of the sixth transistor T6 is connected to the $i^{th}$ emission control line Ei. The sixth transistor M6 is turned on by the gate-on level of the emission control signal supplied to the $i^{th}$ emission control line Ei. Accordingly, the fifth transistor T5 and the sixth transistor T6 may be simultaneously controlled.

The seventh transistor T7 is connected between the second electrode (i.e., third node N3) of the first transistor T1 and the first node N1. A gate electrode of the seventh transistor T7 is connected to the $i^{th}$ scan line Si. The seventh transistor T7 is turned on by a gate-on level of the scan signal supplied to the $i^{th}$ scan line Si to electrically connect the second electrode of the first transistor T1 and the first node N1. When the seventh transistor T7 is turned on, the first transistor T1 is connected in a diode form. Accordingly, data writing and threshold voltage compensation for the first transistor T1 may be performed together.

The storage capacitor Cst is connected between the first driving power VDD and the first node N1.

connection defects of the transistors inside the pixel PX may be detected based on the detection current I_d flowing through the data line Dj during the inspection period.

Figure 4A:
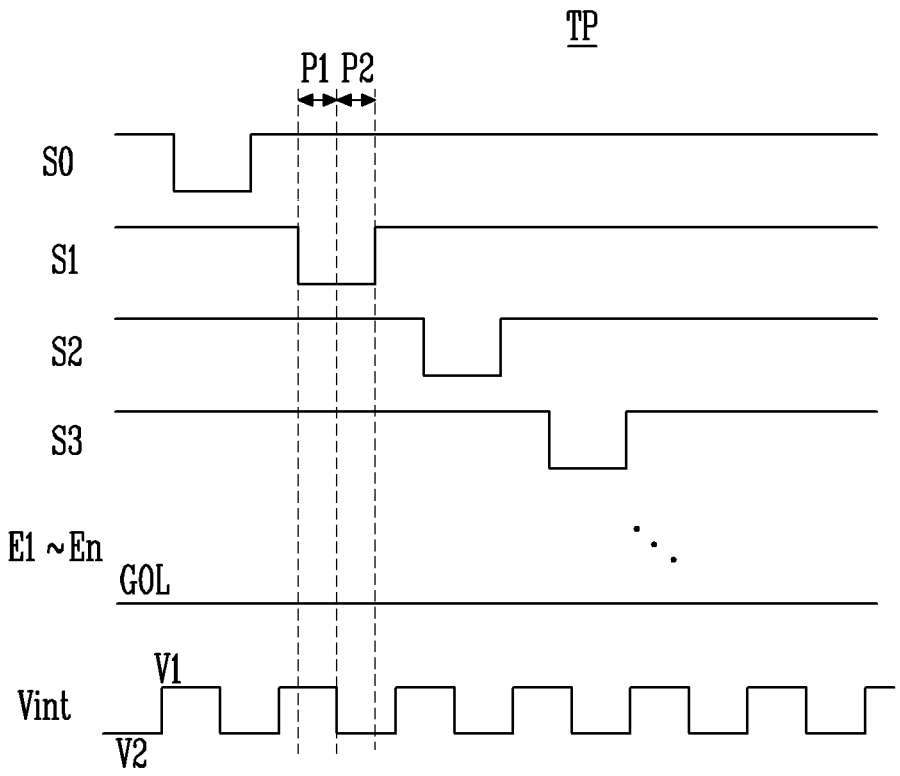
FIG. 4A illustrates a waveform diagram showing an example of an operation during an inspection period of the display device of FIG. 1.
Figure 4B:
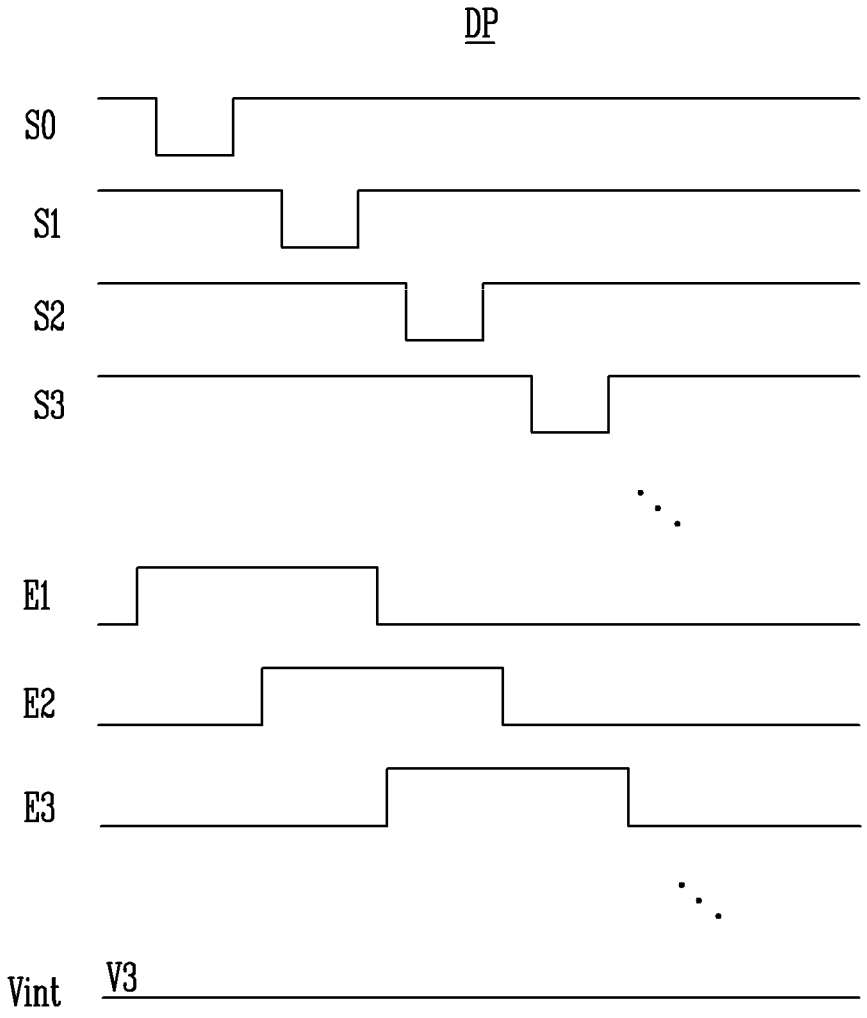
FIG. 4B illustrates a waveform diagram showing an example of an operation during a display period of the display device of FIG. 1.

FIG. 4A illustrates a waveform diagram showing an example of an operation during an inspection period of the display device of FIG. 1, and FIG. 4B illustrates a waveform diagram showing an example of an operation during a display period of the display device of FIG. 1.

Referring to FIG. 3, FIG. 4A, and FIG. 4B, an inspection for detecting defects of the pixels PX is performed during an inspection period TP, and an image may be displayed during the display period DP. In addition, scan signals may be sequentially outputted to the scan lines S0, S1, S2, S3, . . . during each of the inspection period TP and the display period DP.

The dummy scan line S0 illustrated in FIG. 4A and FIG. 4B may be a scan line configured to drive the pixels PX having the pixel circuit PXC of FIG. 3.

As illustrated in FIG. 4A, the emission control signal supplied to the emission control lines E1 to En during the inspection period TP can maintain a gate-on level GOL. Accordingly, the fifth and sixth transistors T5 and T6 may be turned on during the inspection period TP.

The inspection period TP may include a first period P1 and a second period P2. A current flowing through pixels included in one horizontal line (or pixel row) during the first period P1 and the second period P2 may be detected. For example, a current flowing through each of the data lines from pixels arranged in the first horizontal line may be detected during the first period P1 and the second period P2 illustrated in FIG. 4A. A scan signal supplied to a scan line (e.g., a set or predetermined scan line) may have a gate-on level during the first period P1 and the second period P2.

During the inspection period TP, the power line PL may supply the first power Vint to the pixel unit (100 of FIG. 1) in a form of a pulse alternating a first level V1 and a second level V2. The second level V2 may be set to be lower than the first level V1.

Outputs of the gate-on level of the scan signal and the first level V1 of the first power Vint may overlap each other during the first period P1. In addition, outputs of the gate-on level of the scan signal and the second level V2 of the first power Vint may overlap each other during the second period P2. That is, during the inspection period TP, the voltage of the first power Vint may change from the first level V1 to the second level V2 to overlap a period during which the scan signal has the gate-on level.

The operation and inspecting method of the display device during the first period P1 and the second period P2 will be described in detail with reference to FIG. 5 to FIG. 11.

As illustrated in FIG. 4B, during the display period DP, the emission control signal may be sequentially outputted to the emission control lines E1, E2, E3, . . . . For example, a gate-off period of the emission control signal supplied to the $i^{th}$ emission control line Ei may overlap gate-on periods of the scan signal supplied to the $(i-1)^{th}$ scan line S(i−1) and the $i^{th}$ scan line Si.

In addition, the voltage of the first power Vint may maintain a third level V3 during the display period DP. The gate voltage of the first transistor T1 and the voltage of the first electrode of the light emitting element LD may be initialized by the first power of the third level V3 during the display period DP. According to some example embodiments, the third level V3 may be substantially the same as the second level V2. Alternatively, the third level V3 may be set to a value between the first level V1 and the second level V2.

As such, the display device (1000 in FIG. 1) according to some example embodiments of the present invention may maintain the fifth and sixth transistors T5 and T6 to be in a turn-on state during the inspection period TP, may supply the first power Vint of a pulse type to the pixels PX.

Figure 5:
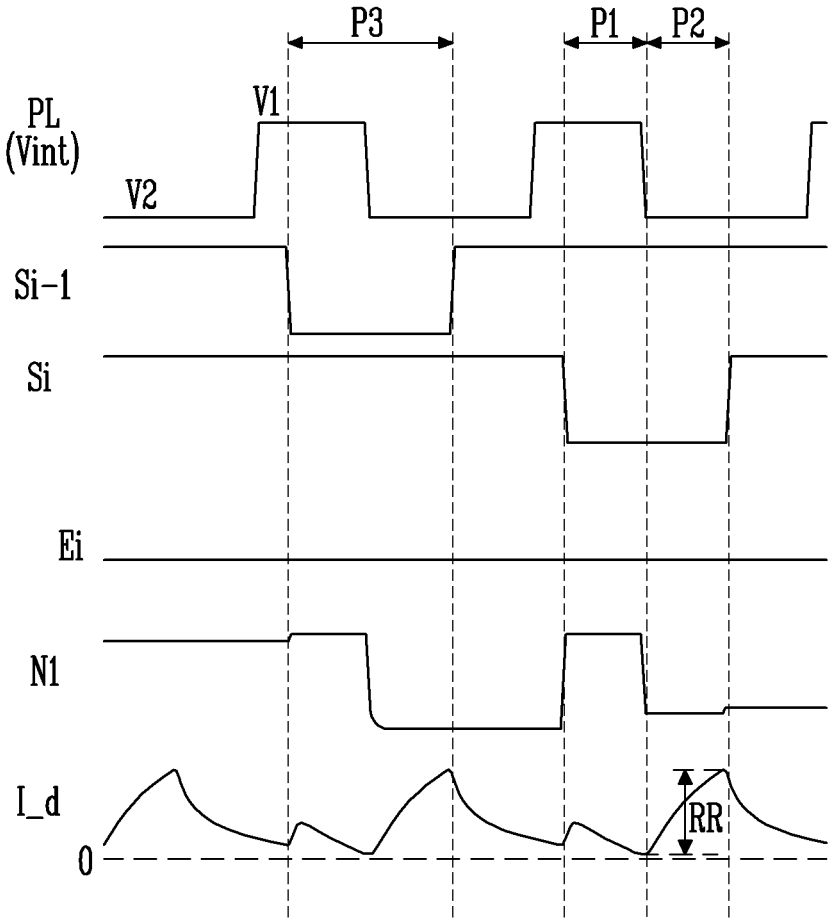
FIG. 5 illustrates a waveform diagram showing an example of a current detected from the pixel of FIG. 3 during an inspection period.
Figure 6A:
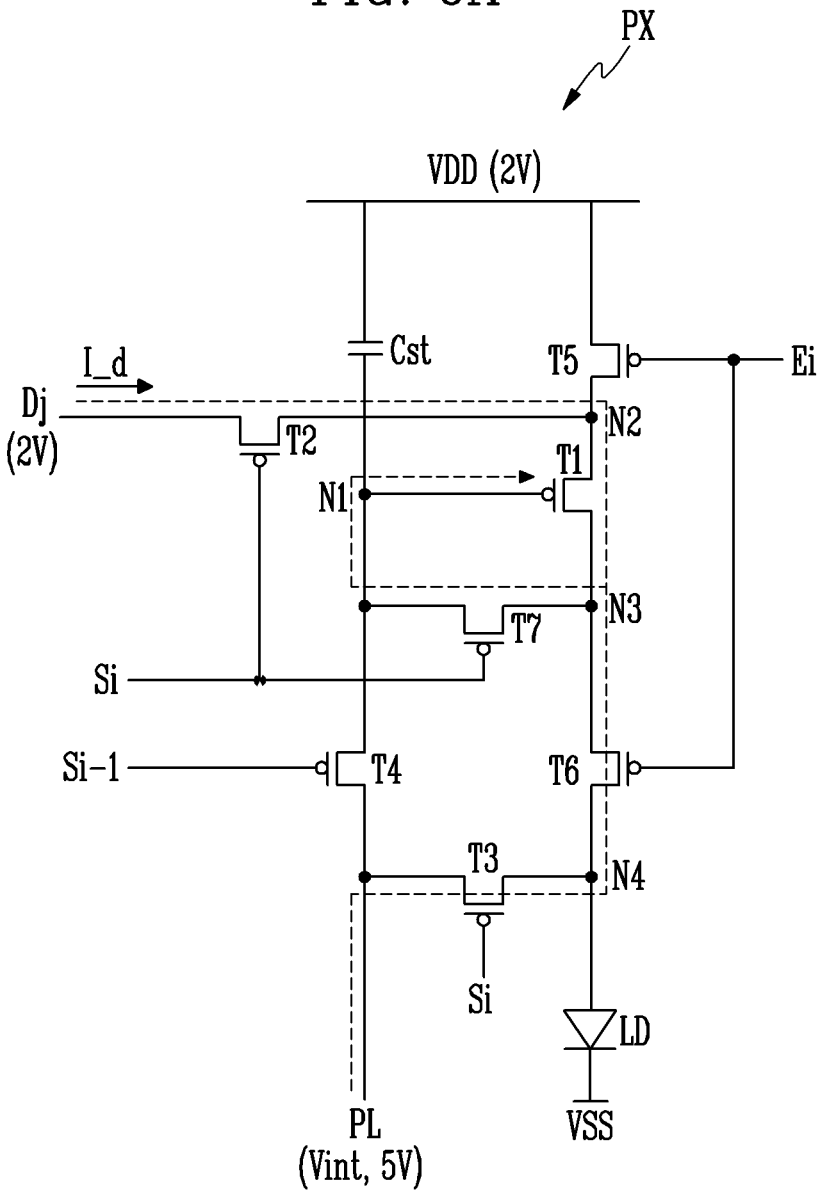
FIG. 6A illustrates an example of a current path formed during a first period of FIG. 5.
Figure 6B:
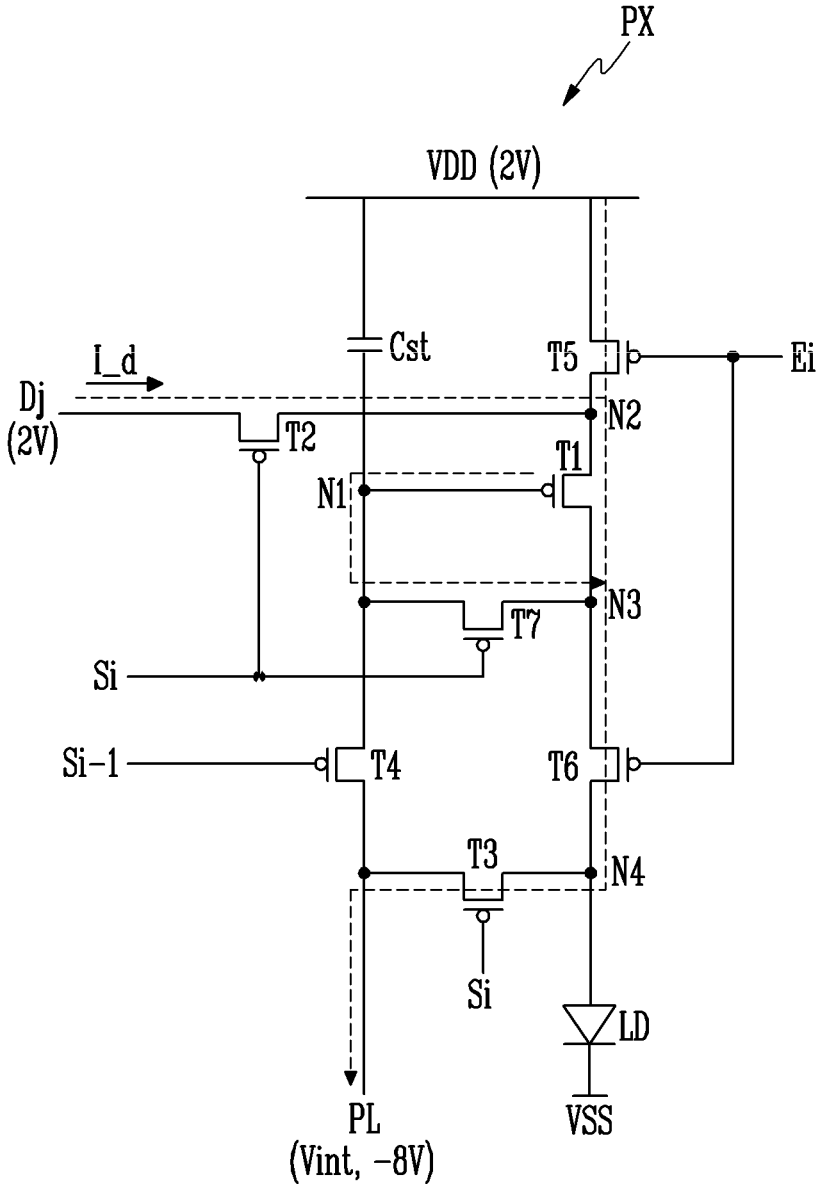
FIG. 6B illustrates an example of a current path formed during a second period of FIG. 5.

FIG. 5 illustrates a waveform diagram showing an example of a current detected from the pixel of FIG. 3 during an inspection period, FIG. 6A illustrates an example of a current path formed during a first period of FIG. 5, and FIG. 6B illustrates an example of a current path formed during a second period of FIG. 5.

For better understanding and ease of description, FIG. 5 to FIG. 6B will be described based on the pixel PX described with reference to FIG. 3. In addition, FIG. 5 shows the detection current I_d at the normal pixel PX.

Referring to FIG. 5 to FIG. 6B, during the inspection period, the emission control signal may be outputted in a gate-on level, and the voltage of the first power Vint may be supplied to the power supply line PL in a form of a pulse alternating the first level V1 and the second level V2.

According to some example embodiments, the voltage supplied to the data line Dj during the inspection period may be substantially the voltage of the first driving power VDD. Accordingly, connection defects of transistors (e.g., set or predetermined transistors) may be relatively easily inferred based on a detected amount of current flowing in the data line Dj.

The fifth transistor T5 and the sixth transistor T6 may be turned on by thee emission control signal of the gate-on level. Accordingly, the fifth transistor T5 and the sixth transistor T6 may be turned on during the first period P1 and the second period P2.

The scan signal of the gate-on level may be supplied to the $i^{th}$ scan line Si during the first period P1 and the second period P2. As a result, the second transistor T2, the third transistor T3, and the seventh transistor T7 may be turned on. According to some example embodiments, the first level V1 of the first power Vint may be greater than an inspection voltage supplied to the data line Dj and the voltage of the first driving power VDD. For example, as illustrated in FIG. 6A, the first level V1 may be about 5 V, and the voltage supplied to the data line Dj may be about 2 V.

During the first period P1, the voltage of the first power Vint may be supplied to the first node N1 through the third transistor T3, the sixth transistor T6, and the seventh transistor T7. Accordingly, the voltage of the first node N1 (i.e., the gate voltage of the first transistor T1) may be increased. In addition, during the first period P1, the voltage of the third node N3 and the voltage of the first node N1 are higher than that of the second node N2, and thus a very weak current path may be formed. A current path may be formed from the data line Dj to the power line PL through the first transistor T1 and the third transistor T3.

Therefore, the detection current I_d during the first period P1 of the normal pixel PX may be substantially unchanged, or may decrease near OA as shown in the waveform of FIG. 5. Hereinafter, when the detection current I_d flows from the data line Dj to the power line PL through the first transistor T1 and the third transistor T3, the detection current I_d may be expressed as a positive current in a waveform diagram.

During the second period P2, the voltage of the first power Vint may drop to the second level V2. The second level V2 may be smaller than the inspection voltage supplied to the data line Dj and the voltage of the first driving power VDD. The voltage of the first node N1 may drop due to the first power Vint of the second level V2. Because a magnitude of a gate-source voltage of the first transistor T1 increases, a magnitude of a current flowing from the second node N2 to the third node N3 may increase. Therefore, the detection current I_d in the normal pixel PX may be increased during the second period P2 as shown in the waveform of FIG. 5. This increase may be determined by a reference range RR. According to some example embodiments, the reference range RR may be determined based on currents detected at time points (e.g., set or predetermined time points) within the second period P2. For example, the reference range RR may include information related to a change amount and a current direction between the detection current I_d at the time point of the second period P2 and the detection current I_d at an end point.

As such, current paths of the first period P1 and the second period P2 may be formed to pass through at least one of the first transistor T1, the second transistor T2, the third transistor T3, the fifth transistor T5, the sixth transistor T6, or the seventh transistor T7. Therefore, the inspector (700 in FIG. 2) may detect a defect of the pixel PX due to an opening and/or short circuit in at least one of the first to seventh transistors T1 to T7 by using the detection current I_d of the first period P1 and the second period P2. As a result, accuracy and reliability of pixel defect detection may be improved, and image quality may be improved.

Meanwhile, the third period P3 is a period for detecting a connection defect of a pixel in the $(i-1)^{th}$ horizontal line, and same driving as during the first and second periods P1 and P2 may be performed on the pixel of the $(i-1)^{th}$ horizontal line.

Figure 7:
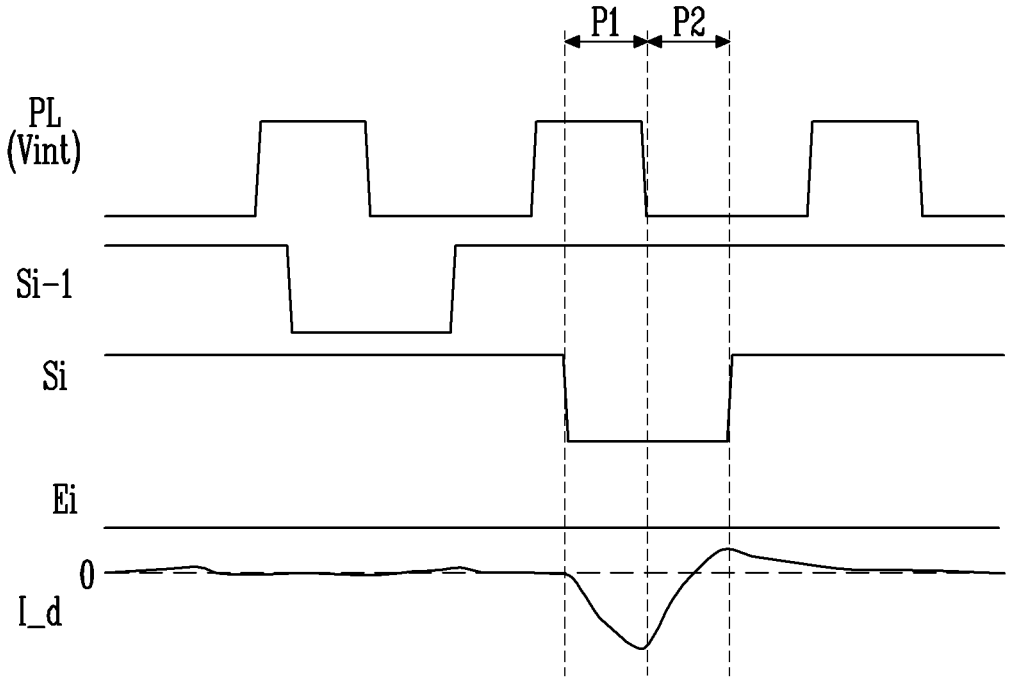
FIG. 7 illustrates a waveform diagram for describing an example of a pixel connection defect detected during the first period.
Figure 8:
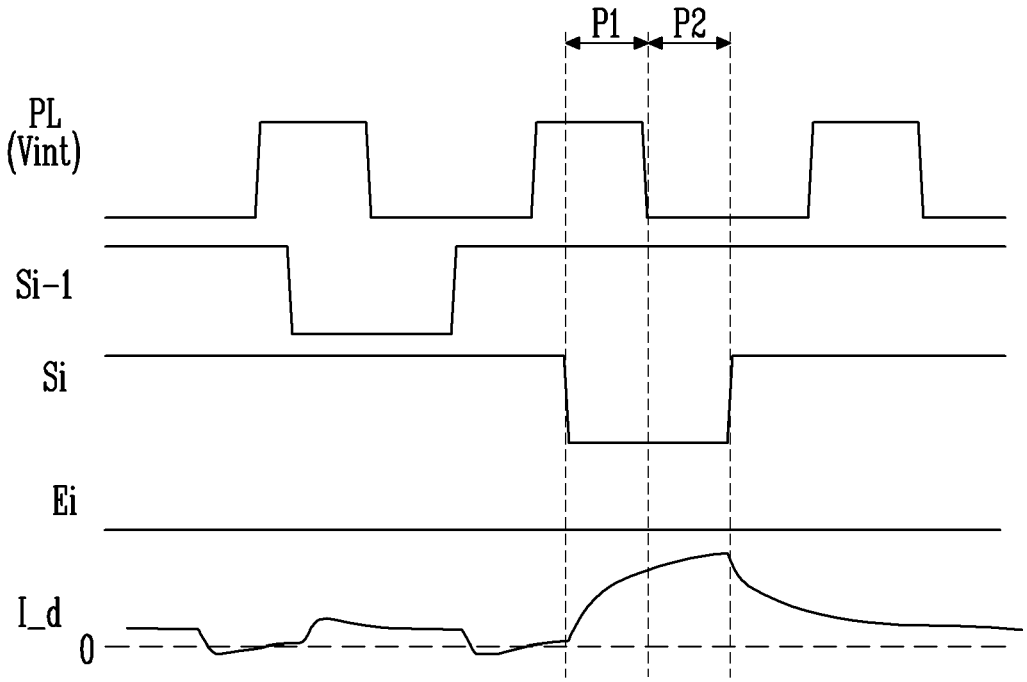
FIG. 8 illustrates a waveform diagram for describing another example of a pixel connection defect detected during the first period.

FIG. 7 illustrates a waveform diagram for describing an example of a pixel connection defect detected during the first period, and FIG. 8 illustrates a waveform diagram for describing another example of a pixel connection defect detected during the first period.

According to some example embodiments, FIG. 7 shows a waveform in which a direction of the detection current I_d changes during the first period P1, and FIG. 8 shows a waveform in which the detection current I_d increases during the first period P1.

Referring to FIG. 2, FIG. 3, FIG. 5, FIG. 7, and FIG. 8, the inspector 700 may calculate the detection current I_d during the first period P1 and the second period P2.

The inspector 700 may detect whether the pixel PX is defective based on the change in the detection current I_d.

According to some example embodiments, as illustrated in FIG. 7, when the direction of the detection current I_d changes (that is, when the detection current I_d is outputted as a negative number), the inspector 700 may determine that the pixel PX has a defect.

For example, when the source electrode and/or the drain electrode of the seventh transistor T7 is opened, the voltage of the first level V1 is not supplied to the first node N1 during the first period P1. In this case, the voltage of the first node N1 may maintain a level that is similar to the second level V2 of the first power Vint that was supplied when the fourth transistor T4 was turned on. Therefore, the first transistor T1 may be turned on during the first period P1. During the first period P1, the first level V1 of the first power Vint is greater than the inspection voltage, and thus the detection current I_d may flow from the power line PL to the data line Dj through the first transistor T1. That is, the current direction of the detection current I_d in the current path may be reversely changed. In addition, in the first period P1, the magnitude of the detection current I_d may increase in the negative direction.

For example, even when the first transistor T1 is short-circuited, the direction of the detection current I_d during the first period P1 may be reversely changed.

Accordingly, when the detection current I_d is changed from the power line PL to the data line Dj during the first period P1, the pixel PX may be determined to have a defect due to an opening of the seventh transistor T7 or a short circuit of the first transistor T1.

As illustrated in FIG. 8, when the detection current I_d during the first period P1 increases, the inspector 700 may determine that the pixel PX has a connection defect. As described with reference to FIG. 6A, in the case of a normal pixel, during the first period P1, the detection current I_d should drop close to or maintained at 0 A.

However, when the power line PL and the $i^{th}$ scan line Si are short-circuited, the gate-on level of the scan signal may be transferred to the power line PL. Accordingly, the voltage of the power line PL may be lower than the voltage of the data line Dj (e.g., the inspection voltage). When the voltage of the power line PL is transferred to the first node N1, the first transistor T1 may be turned on.

When the first transistor T1 is turned on, the detection current I_d may flow from the data line Dj to the power line PL through the pixel circuit PXC.

Therefore, when the detection current I_d increases during the first period P1, it may be determined that the pixel PX has a defect according to a short circuit of a signal line (e.g., a set or predetermined signal line).

Figure 9:
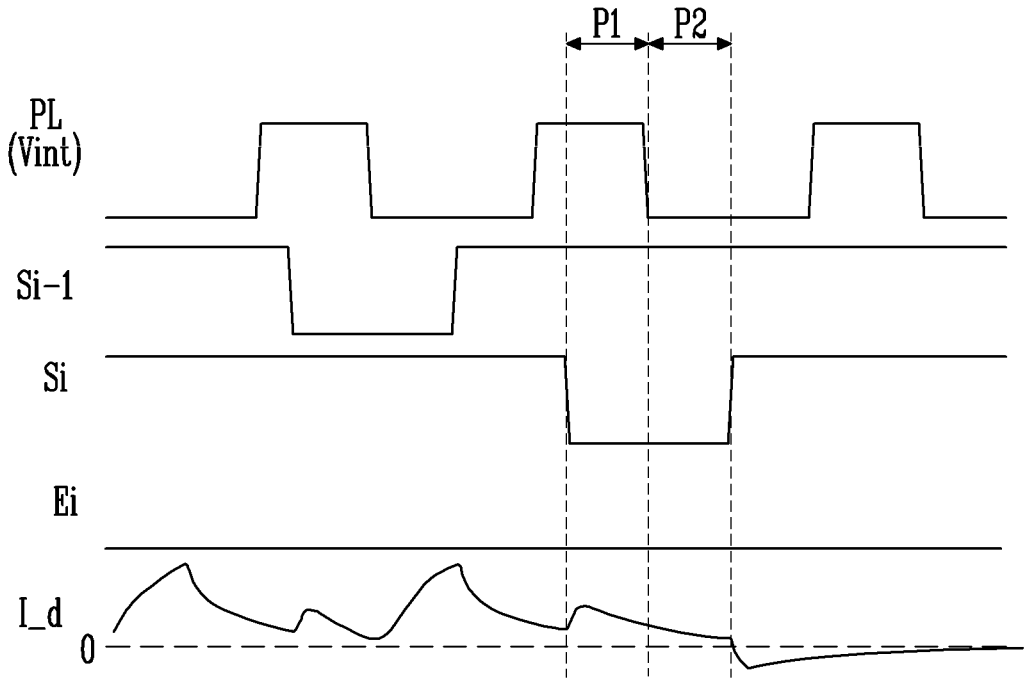
FIG. 9 illustrates a waveform diagram for describing an example of a pixel connection defect detected during the second period.
Figure 10:
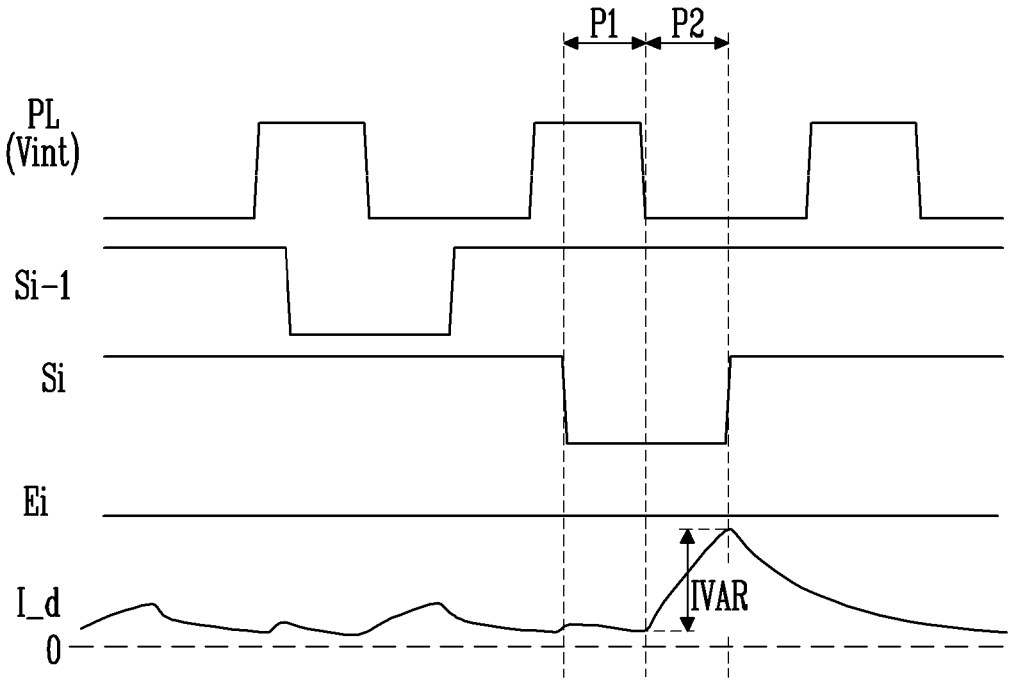
FIG. 10 illustrates a waveform diagram for describing another example of a pixel connection defect detected during the second period.
Figure 11:
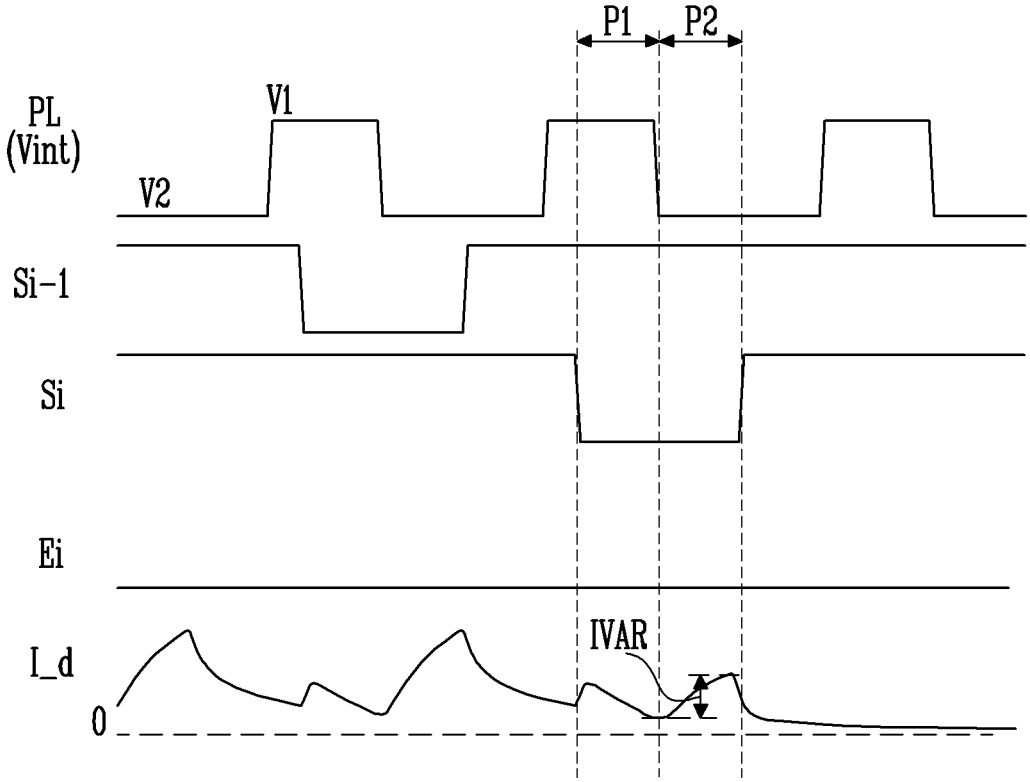
FIG. 11 illustrates a waveform diagram for describing yet another example of a pixel connection defect detected during the second period.

FIG. 9 illustrates a waveform diagram for describing an example of a pixel connection defect detected during the second period, FIG. 10 illustrates a waveform diagram for describing another example of a pixel connection defect detected during the second period, and FIG. 11 illustrates a waveform diagram for describing yet another example of a pixel connection defect detected during the second period.

FIG. 9 shows a waveform in which the detection current I_d decreases during the second period P2, FIG. 10 shows a waveform in which a rising amount of the detection current I_d of the second period P2 is greater than the reference range RR, and FIG. 11 shows a waveform in which a rising amount of the detection current I_d of the second period P2 is smaller than the reference range RR.

Referring to FIG. 2, FIG. 3, FIG. 5, FIG. 9, FIG. 10, and FIG. 11, the inspector 700 may calculate the detection current I_d and a change amount IVAR of the detection current during the second period P2.

According to some example embodiments, the change amount IVAR of the detection current may be determined by using current values detected at time points (e.g., set or predetermined time points) during the second period P2.

According to some example embodiments, the inspector 700 may compare the change amount IVAR of the detection current and the reference range RR.

When a current direction included in the change amount IVAR of the detection current and a current direction included in the reference range RR are different, the inspector 700 may determine that the pixel PX has a connection defect. According to some example embodiments, as illustrated in FIG. 9, when the detection current I_d decreases during the second period P2, the inspector 700 may determine that a connection defect has occurred in at least one of the transistors included in the current path of the pixel PX. Alternatively, when there is no change in the detection current I_d during the second period P2, the inspector 700 may determine that a connection defect has occurred in at least one of the transistors included in the current path of the pixel PX.

According to some example embodiments, when at least one of the first transistor T1, the second transistor T2, the third transistor T3, or the sixth transistor T6 arranged in the current path is opened, a current path between the power line PL and the data line Dj is cut off. Therefore, only the current path between the first driving power VDD and the data line Dj exists during the second period P2. In this case, because the voltage of the first driving power VDD and the voltage of the data line Dj (e.g., the inspection voltage) are the same or similar, the detection current I_d does not change or may gradually decrease.

According to some example embodiments, when the fifth transistor T5 is short-circuited, most current flows from the power line PL to the first driving power VDD during the second period P2, and thus the detection current I_d may not change or may gradually decrease.

Therefore, as illustrated in FIG. 9, when the detection current I_d does not increase during the second period P2, the pixel PX may be determined to have defects due to the opening or short circuit of the transistors.

When the detection current I_d increases during the second period P2, the inspector 700 may compare the change amount of the second current change IVAR and the reference range RR. For example, the reference range RR may be a range in which a margin or an offset in which tolerance or the like is reflected is applied to a reference value (e.g., a set or predetermined reference value).

When the change amount IVAR of the detection current is out of the reference range, it may be determined that at least one of the transistors arranged in the current path is defective.

As illustrated in FIG. 10, according to some example embodiments, when the change amount IVAR of the detection current is greater than the reference range RR (when the increasing amount of the detection current I_d is greater than the reference range RR), the inspector 700 may determine that the pixel PX has a defect.

For example, when a source electrode, a drain electrode, and/or a gate electrode of the fifth transistor T5 are opened, a current branching from the second node N2 toward the fifth transistor T5 decreases, and thus the detection current I_d in the data line Dj may increase When at least one of the first transistor T1, the second transistor T2, the third transistor T3, the fourth transistor T4, or the sixth transistor T6 arranged in the current path between the data line Dj and the power line PL is short-circuited, the equivalent resistance in the current path decreases, and thus the detection current I_d may increase.

Alternatively, when a gate electrode of the fourth transistor T4 is opened, the gate voltage of the fourth transistor T4 may be coupled to a voltage that is lower than the gate-on level of the scan signal depending on the voltage change (voltage drop) of the first power Vint. The voltage of the first node N1 may be further decreased by coupling the gate voltage of the fourth transistor T4, and the detection current I_d during the second period P2 may be greatly increased.

Accordingly, when the change amount IVAR of the detection current during the second period P2 is greater than the reference range RR, it may be determined that the pixel PX has a defect.

As illustrated in FIG. 11, according to some example embodiments, when the change amount IVAR of the detection current is smaller than the reference range RR (when the increasing amount of the detection current I_d is smaller than the reference range RR), the inspector 700 may determine that the pixel PX has a defect.

For example, when the gate electrode of the sixth transistor T6 is opened, the gate voltage of the sixth transistor T6 may be coupled by a change in the voltage level of the first power Vint during the second period P2. Because a gate voltage of the coupled sixth transistor T6 is greater than the gate-on level of the emission control signal, a current flowing through the sixth transistor T6 is reduced. Accordingly, the change amount IVAR of the detection current during the second period P2 may be smaller than the reference range RR.

As a result, when the increasing amount of the detection current I_d during the second period P2 is smaller than the reference range RR, it may be determined that the pixel PX has a defect due to the opening of the gate electrode of the sixth transistor T6.

When the detection current I_d during the first period P1 does not change or decreases near 0 A and the increasing amount of the detection current I_d during the second period P2 is included within the reference range RR, the inspector 700 may determine the pixel PX as a normal pixel.

Meanwhile, according to the contents described with reference to FIG. 5 to FIG. 11, a defect due to a short circuit of the first transistor T1 and/or an opening of the seventh transistor T7 during the first period P1 may be confirmed, and a defect of the pixel PX due to short circuit/opening of the first to sixth transistors T1 to T6 may be confirmed depending on the waveform of the measurement current I_d during the second period P2. In addition, the waveforms of FIG. 7 to FIG. 11 are examples, and when a current of a waveform that is different from the normal waveform is detected, it may be determined that there is a connection defect inside the pixel.

As described above, the display device according to some example embodiments of the present invention may form a current path to pass through at least one of the first transistor T1, the second transistor T2, the third transistor T3, the fifth transistor T5, the sixth transistor T6, or the seventh transistor T7*d* during the first period P1 and the second period P2 of the inspection period based on the swing of the first power Vint. Accordingly, an opening fault and/or a short-circuit fault for at least one of the first to seventh transistors T1 to T7 using the detection current I_d during the first period P1 and the second period P2 may be detected. Therefore, accuracy and reliability of detection of connection defects of constituent elements inside the pixels may be improved, and image quality may be improved.

Figure 12:
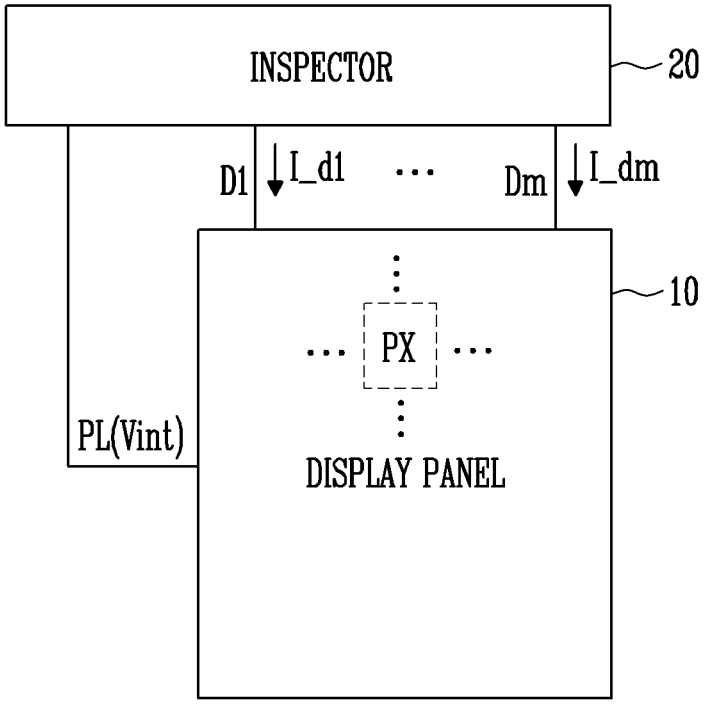
FIG. 12 illustrates a block diagram showing an example of the display device of FIG. 1.

FIG. 12 illustrates a block diagram showing an example of the display device of FIG. 1.

Referring to FIG. 1 and FIG. 12, the display device may include a display panel 10 and an inspector 20.

The display panel 10 may include a pixel unit 100. According to some example embodiments, the display panel 10 may further include at least portions of a scan driver 200, an emission driver 300, and a power supply 600. The scan driver 200, the emission driver 300, and the power supply 600 may be directly mounted on the display panel 10, or may be connected to the display panel 10 by a printed circuit board. Alternatively, at least portions of the scan driver 200, the emission driver 300, and the power supply 600 may be integrated in a peripheral portion of the display panel 10.

The inspector 20 may be connected to the data lines D1 to Dm and the power line PL. During the inspection period, the inspector 20 may supply an inspection voltage for inspection through the data lines D1 to Dm, and may supply a voltage of the first power Vint in a pulse form through the power line PL. Accordingly, a current path from each of the data lines D1 to Dm to the power supply line PL through the pixels PX may be formed.

The inspector 20 may determine whether the pixels PX is defective by analyzing detection currents I_d1 to I_dm through the data lines D1 to Dm, respectively.

According to some example embodiments, the inspector 20 may be included as a constituent element inside the display device. According to some example embodiments, the inspector 20 may be connected to the display panel 10 outside of the display device. For example, the inspector 20 is configured in a form of an IC, and may be connected to the display panel 10.

According to some example embodiments, the display panel 10 may further include a data driver 400 and a timing controller 500. When the inspector 20 is driven, the data driver 400 may not be driven.

Figure 13:
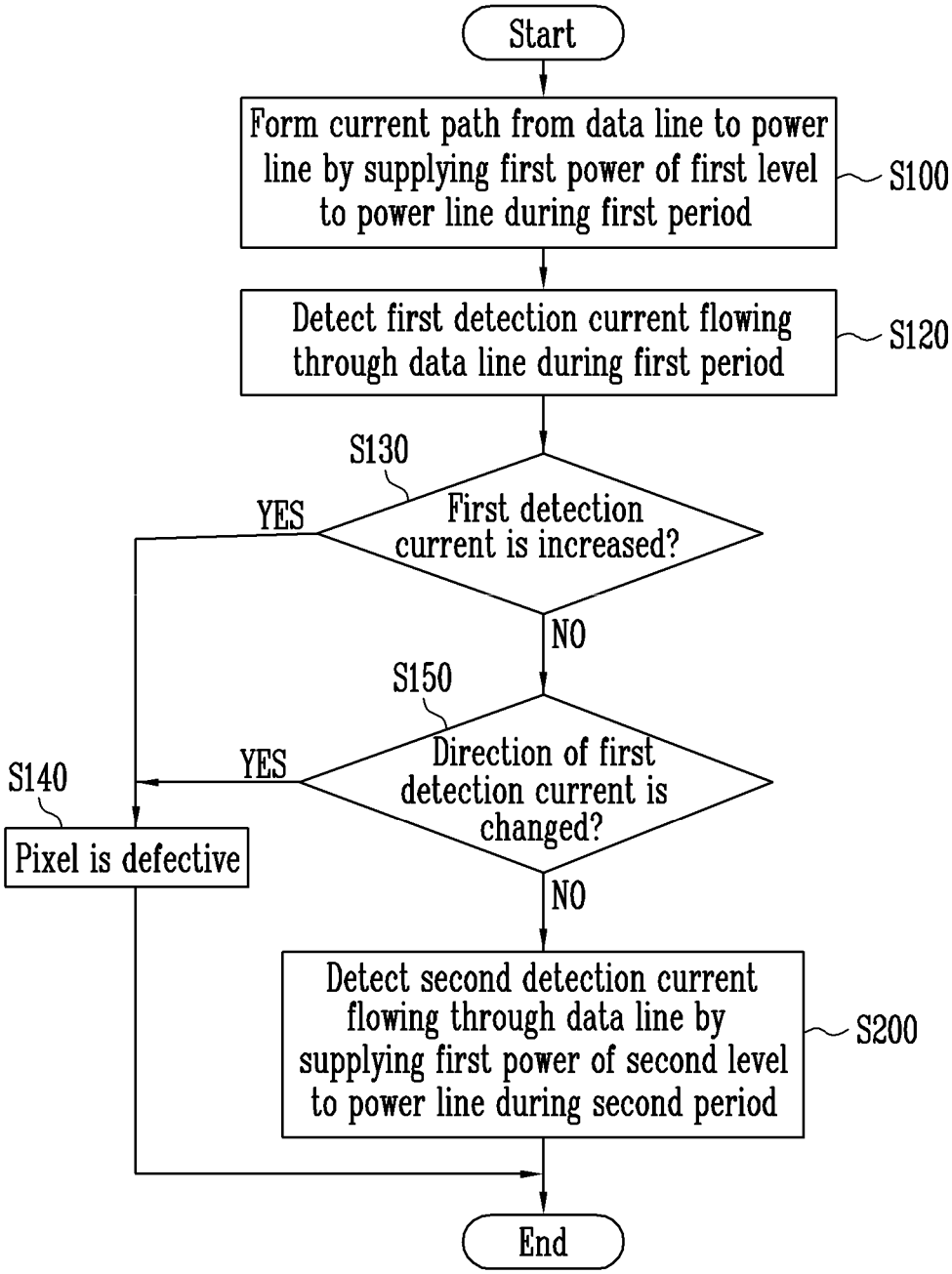
FIG. 13 illustrates a flowchart showing an inspecting method of a display device according to some example embodiments of the present invention.
Figure 14:
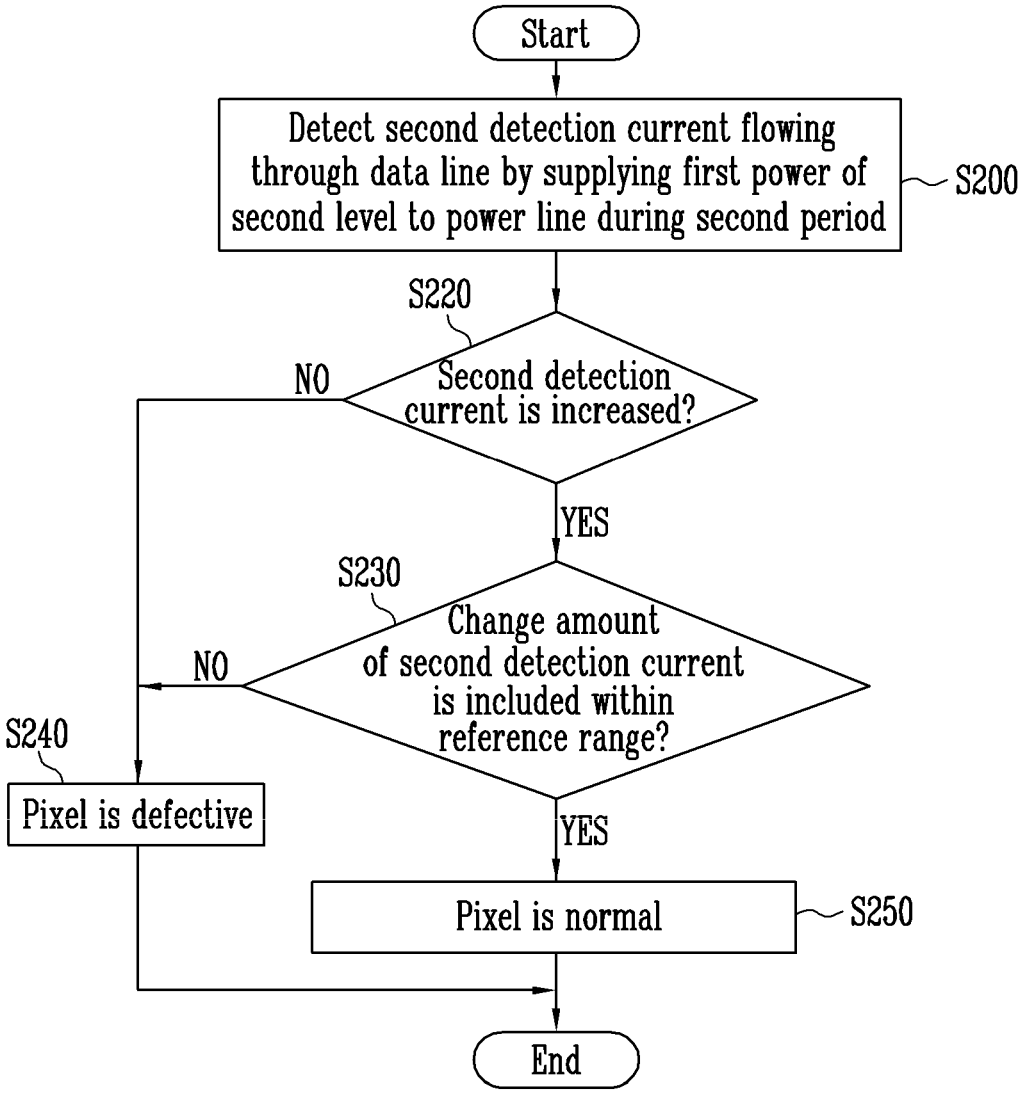
FIG. 14 illustrates a flowchart showing an example of an inspecting method of the display device of FIG. 13.

FIG. 13 illustrates a flowchart showing an inspecting method of a display device according to some example embodiments of the present invention, and FIG. 14 illustrates a flowchart showing an example of an inspecting method of the display device of FIG. 13.

Referring to FIG. 13 and FIG. 14, an inspecting method of a display device may include: forming a current path by supplying a first power of a first level to a power line to form a current path during a first period (S100); detecting a current flowing through a data line during a first period (S120); and detecting a current flowing through the data line by supplying a first power of a second level that is lower than the first level to the power line during a second period.

The current path may be formed to flow from the data line through the pixel to the power line. In this case, an inspection voltage for inspection may be supplied to the data line. The first level of the first power may be greater than the inspection voltage, and the second level of the first power may be less than the inspection voltage.

The detecting the current during the first period (S120) may include: determining whether a first detection current is increased (S130); and determining whether a direction of the first detection current is maintained (S150). When the first detection current detected during the first period increases or the direction of the first detection current is changed, it may be determined that the pixel has a defect (S140).

For example, when the first detection current increases, it may be determined that the scan line and the power line connected to the pixel are short circuited. In addition, when the direction of the first detection current is reversely changed, it may be determined that a drain electrode and/or a source electrode of the seventh transistor (T7 of FIG. 3) are opened or the first transistor (T1 of FIG. 1) is short circuited.

However, this is an example, and when a current of a waveform that is different from a normal waveform of the detection current I_d as shown in FIG. 5 is detected, it may be determined that there is a connection defect in the pixel.

When the first detection current is not substantially changed or is decreased, it may be determined that the pixel is normal during the first period.

As illustrated in FIG. 14, when the second current is detected (S200) during the second period, whether the pixel is defective may be determined by analyzing the second detection current.

According to some example embodiments, it may be determined whether the second detection current is increased (S220), and the change amount of the second detection current and a reference range (e.g., a set or predetermined reference range) may be compared (S230).

When the second detection current is not increased (that is, when the current is not increased during the second period), it may be determined that the pixel has a defect (S240). When the second detection current increases, the change amount of the second detection current and the reference range may be compared (S230). When the change amount of the second detection current is out of the reference range, it may be determined that there is an open or short circuit defect (i.e., a pixel defect) in at least one of the transistors arranged in the current path of the pixel (S240).

When the change amount of the second detection current is within the reference range, the pixel may be determined as normal (S250).

Meanwhile, because the inspecting method of the display device of FIG. 13 and FIG. 14 has been described in detail with reference to FIG. 5 to FIG. 11, description of the ping contents will be omitted.

As described above, in accordance with a display device and an inspecting method thereof according to embodiments of the present invention, a current path may be formed such that a current (e.g., a set or predetermined current) passes through all of the transistors turned on by the scan signal and the emission control signal based on the swing of the first power during the first period and the second period of the inspection period. Accordingly, connection (short circuit/open) defects to all transistors included in the pixel may be confirmed by using the detection currents during the first period and the second period. Therefore, accuracy and reliability of detection of connection defects of constituent elements inside the pixels may be improved, and image quality may be improved.

While aspects of some example embodiments of the present invention has been shown and described with reference to specific embodiments thereof, it will be understood by those skilled in the art that various changes in form and detail may be made therein without departing from the spirit and scope of the invention as defined by the following claims and their equivalents.

What is claimed is:

1. A display device comprising:

a plurality of pixels connected to scan lines, emission control lines, data lines, and a power line;

a scan driver configured to supply a scan signal to the scan lines; and an emission driver configured to supply an emission control signal to the emission control lines, wherein a voltage of a first power supplied to the power line during an inspection period has a pulse form alternating between a first level and a second level that is lower than the first level, and the display device is configured to maintain the voltage of the first power at a third level.

2. The display device of claim 1, wherein the display device is configured to maintain the emission control signal at a gate-on level during the inspection period.

3. The display device of claim 2, wherein outputs of a gate-on level of the scan signal and the first level of the first power overlap in a first period of the inspection period, and outputs of the gate-on level of the scan signal and the second level of the first power overlap in a second period of the inspection period.

4. The display device of claim 3, wherein in the inspection period, the display device is configured to change the voltage of the first power from the first level to the second level by overlapping a period in which the scan signal has a gate-on level.

5. The display device of claim 3, wherein an inspection voltage is supplied to the data lines in the inspection period, the first level of the first power is greater than that of the inspection voltage, and the second level of the first power is less than that of the inspection voltage.

6. The display device of claim 5, further comprising an inspector configured to detect a current flowing through the data lines during the inspection period.

7. The display device of claim 6, wherein the inspector is configured to determine whether or not the pixel is defective based on a result of comparing a change in a current detected in the first period and a change in a current detected in the second period with a reference current.

8. The display device of claim 6, wherein a pixel of an $i^{th}$ horizontal line (where i is a natural number) among the pixels comprises:

a light emitting element;

a first transistor configured to control a driving current flowing to the light emitting element based on a voltage of a first node, and connected between a second node and a third node;

a second transistor connected between a $j^{th}$ data line (where j is a natural number) and the second node and turned on in response to the gate-on level of the scan signal supplied to an $i^{th}$ scan line; and a third transistor connected between the power line and a first electrode of the light emitting element and turned on by the gate-on level of the scan signal supplied to the $i^{th}$ scan line, wherein a current path is formed from the $j^{th}$ data line to the power line through the third transistor and the first transistor in the first period and the second period.

9. The display device of claim 8, wherein the pixel further comprises:

a fourth transistor connected between the first node and the power line and turned on in response to the gate-on level of the scan signal supplied to a $(i-1)^{th}$ scan line;

a fifth transistor connected between a first driving power line and configured to supply a first driving power and the second node and to be turned on in response to a gate-on level of the emission control signal supplied to an $i^{th}$ emission control line;

a sixth transistor connected between the third node and the first electrode of the light emitting element and configured to be turned on in response to the gate-on level of the emission control signal supplied to the $i^{th}$ emission control line; and a seventh transistor connected between the first node and the third node and configured to be turned on in response to the gate-on level of the scan signal supplied to the $i^{th}$ scan line.

10. The display device of claim 5, further comprising:

a power supply configured to supply the first power to the power line; and a data driver configured to supply a data signal to the data lines during a display period.

11. The display device of claim 1, wherein the third level is equal to or greater than the second level and smaller than the first level.

12. An inspecting method for a display device including a data line, a scan line, a power line, and a pixel connected to the data line, the scan line, and the power line, the method comprising:

forming a current path flowing from the data line to the power line through the pixel by supplying a first power having a first level during a first period;

detecting a current flowing through the data line during the first period; and detecting a current flowing through the data line by supplying the first power having a second level lower than the first level to the power line during a second period.

13. The inspecting method of claim 12, wherein a scan signal supplied to the scan line has a gate-on level during the first period and the second period.

14. The inspecting method of claim 13, wherein an inspection voltage is supplied to the data line during the first period and the second period, the first level of the first power is greater than the inspection voltage, and the second level of the first power is less than the inspection voltage.

15. The inspecting method of claim 14, wherein detecting the current in the first period comprises:

determining that the pixel has a defect in response to a first detection current detected during the first period increasing or a direction of the first detection current being reversely changed.

16. The inspecting method of claim 15, wherein detecting the current in the second period comprises:

determining that at least one transistor on the current path is defective in response to a second detection current detected during the second period not increasing;

comparing a change amount of the second detection current and a reference range in response to the second detection current increasing; and determining that at least one transistor on the current path is defective in response to the change amount of the second detection current being out of the reference range.

17. The inspecting method of claim 16, wherein the pixel comprises:

a light emitting element;

a first transistor configured to control a driving current flowing to the light emitting element based on a voltage of a first node, and connected between a second node and a third node;

a second transistor connected between the data line and the second node and turned on in response to the gate-on level of the scan signal supplied to the scan line;

a third transistor connected between the power line and a first electrode of the light emitting element and turned on in response to the gate-on level of the scan signal supplied to the scan line;

a fourth transistor connected between the first node and the power line and turned on in response to the gate-on level of the scan signal supplied to a previous scan line;

a fifth transistor connected between a first driving power line for supplying a first driving power and the second node and turned on in response to a gate-on level of an emission control signal supplied to an emission control line;

a sixth transistor connected between the third node and the first electrode of the light emitting element and turned on in response to the gate-on level of the emission control signal supplied to the emission control line; and a seventh transistor connected between the first node and the third node and turned on in response to the gate-on level of the scan signal supplied to the scan line.

18. The inspecting method of claim 17, further comprising determining that the power line and the scan line are short circuited in response to the first detection current increasing.

19. The inspecting method of claim 17, further comprising determining that the seventh transistor is open or the first transistor is short circuited in response to the direction of the first detection current being reversely changed.

20. The inspecting method of claim 17, further comprising determining that a gate electrode of the sixth transistor is open in response to a change amount of the second detection current being less than the reference range.

* * * * *